US005592918A

United States Patent [19]

Suzuki et al.

[11] Patent Number: 5,592,918

[45] Date of Patent: Jan. 14, 1997

[54] INTAKE AIR VOLUME CONTROL DEVICE FOR INTERNAL COMBUSTION ENGINE

[75] Inventors: Norio Suzuki; Yousuke Tachibana, both of Wako, Japan

[73] Assignee: Honda Giken Kogyo Kabushiki Kaisha, Tokyo, Japan

[21] Appl. No.: 508,030

[22] Filed: Jul. 28, 1995

[30] Foreign Application Priority Data

Aug. 10, 1994 [JP] Japan ..... 6-208206

[51] Int. Cl.[6] ..... F02D 41/16

[52] U.S. Cl. ..... 123/339.18; 123/339.22

[58] Field of Search ..... 123/339.16, 339.17, 123/339.18, 339.19, 339.2, 339.21, 339.22, 339.24

[56] References Cited

U.S. PATENT DOCUMENTS 4,993,383 2/1991 Wokan et al. ..... 123/339.17

5,010,862 4/1991 Hashimoto et al. ..... 123/339.16

*Primary Examiner*—Andrew M. Dolinar

*Attorney, Agent, or Firm*—Armstrong, Westerman, Hattori, McLeland & Naughton

[57] ABSTRACT

An intake air volume control device of an internal combustion engine capable of adjusting the intake air volume pertinently irrespective of a variation in characteristic such as a deterioration in durability, a variation in an engine water temperature or an intake absolute pressure or the like is provided. An intake air volume control device for an internal combustion engine in which there is provided a throttle opening degree control means for driving a throttle valve arranged in an air intake system of the internal combustion engine and adjusting an intake air volume comprises a target intake air volume calculating means for calculating a target intake air volume $Q_{IDL}$ in response to an external load of the internal combustion engine, and a target throttle opening degree setting means for setting a target throttle opening degree $TH_O$ in response to the target intake air volume calculated by the target intake air volume calculating means. The throttle valve is driven and controlled by the throttle opening degree control means in response to the target throttle opening degree $TH_O$.

3 Claims, 5 Drawing Sheets

INTAKE AIR VOLUME CONTROL DEVICE FOR INTERNAL COMBUSTION ENGINE

BACKGROUND OF THE INVENTION

This invention relates to an adjustment of an intake air volume under a control of a throttle opening degree in an internal combustion engine provided with a throttle opening degree control means for use in controlling a driving of a throttle valve.

In an internal combustion engine provided with this throttle opening degree control means, a target throttle opening degree is set mainly in response to an operating amount of accelerator such as a pressing amount of an accelerator pedal, and then the throttle valve is driven to the target throttle opening degree so as to adjust an amount of intake air.

The relation of an intake air volume $G_{AIR}$ to a throttle opening degree $\theta_{TH}$ is not in a linear proportional relation but shows a characteristic curve as shown in FIG. 1, and as the throttle opening degree becomes large, the intake air volume is rapidly increased.

Due to such a characteristic of $\theta_{TH}$-$G_{AIR}$ as described above, there occurred problems as follows. If carbon clogs around the throttle valve or in a bypass air passage, it is difficult to keep an amount of variation of the intake air volume $G_{AIR}$ at a suitable value under the idle state that the throttle valve opening degree $\theta_{TH}$ is small, because the amount of variation of the intake air volume $G_{AIR}$. is quite low in respect to an amount of variation of the throttle opening degree $\theta_{TH}$, or an amount of variation of the intake air volume $G_{AIR}$ is apt to excessively increase in response to ON/OFF of an electrical load $E_L$ of an air conditioner or the like as the throttle opening degree $\theta_{TH}$ increases at a low engine water temperature or at a low intake absolute pressure (under an idle feed-back control in particular, variation of the rotational speed of the engine (shock) due to the ON/OFF of the electrical load is intense around the target rotational speed of the engine).

SUMMARY OF THE INVENTION

The present invention has been invented in view of the foregoing, and it is an object of the present invention to provide an intake air volume control device for an internal combustion engine capable of adjusting properly an intake air volume with out being influenced by a characteristic variation such as a deterioration in durability or a variation in engine water temperature or an intake air absolute pressure or the like.

In order to accomplish the aforesaid object, the present invention provides an intake air volume control device for an internal combustion engine in which there is provided a throttle opening degree control means for driving a throttle valve arranged in an air intake system of the internal combustion engine and adjusting an intake air volume, wherein the same is comprised of a target intake air volume calculating means for calculating a target intake air volume in response to an external load of the internal combustion engine, and a target throttle opening degree setting means for setting a target throttle opening degree in response to the target intake air volume calculated by the target intake air volume calculating means, and the throttle valve is driven and controlled by the throttle opening degree control means in response to the target throttle opening degree.

Setting of the target throttle opening degree to a proper value in response to the target intake air volume calculated in reference to an external load condition of the internal combustion engine enables the aforesaid characteristic of $\theta_{TH}$-$G_{AIR}$ to be corrected and a suitable intake air volume to be always adjusted even against a variation in characteristic such as a deterioration in durability or a variation in engine water temperature or intake air absolute pressure and the like.

In the intake volume control device for the internal combustion engine comprising an idling rotational speed feed-back control means for driving the throttle valve arranged in the air intake system of the internal combustion engine, adjusting the intake air volume through the throttle valve opening degree and controlling the idling rotational speed of the internal combustion engine to the target rotational speed, it is possible to prevent the rotational speed of the engine from being substantially varied due to the variation in external load at an operational region near the target rotational speed of the engine when the idling feed-back control carried out.

DETAILED DESCRIPTION OF THE PREFERRED EMBODIMENT

Referring now to FIGS. 2 to 5, one preferred embodiment of the present invention will be described.

Figure 2:
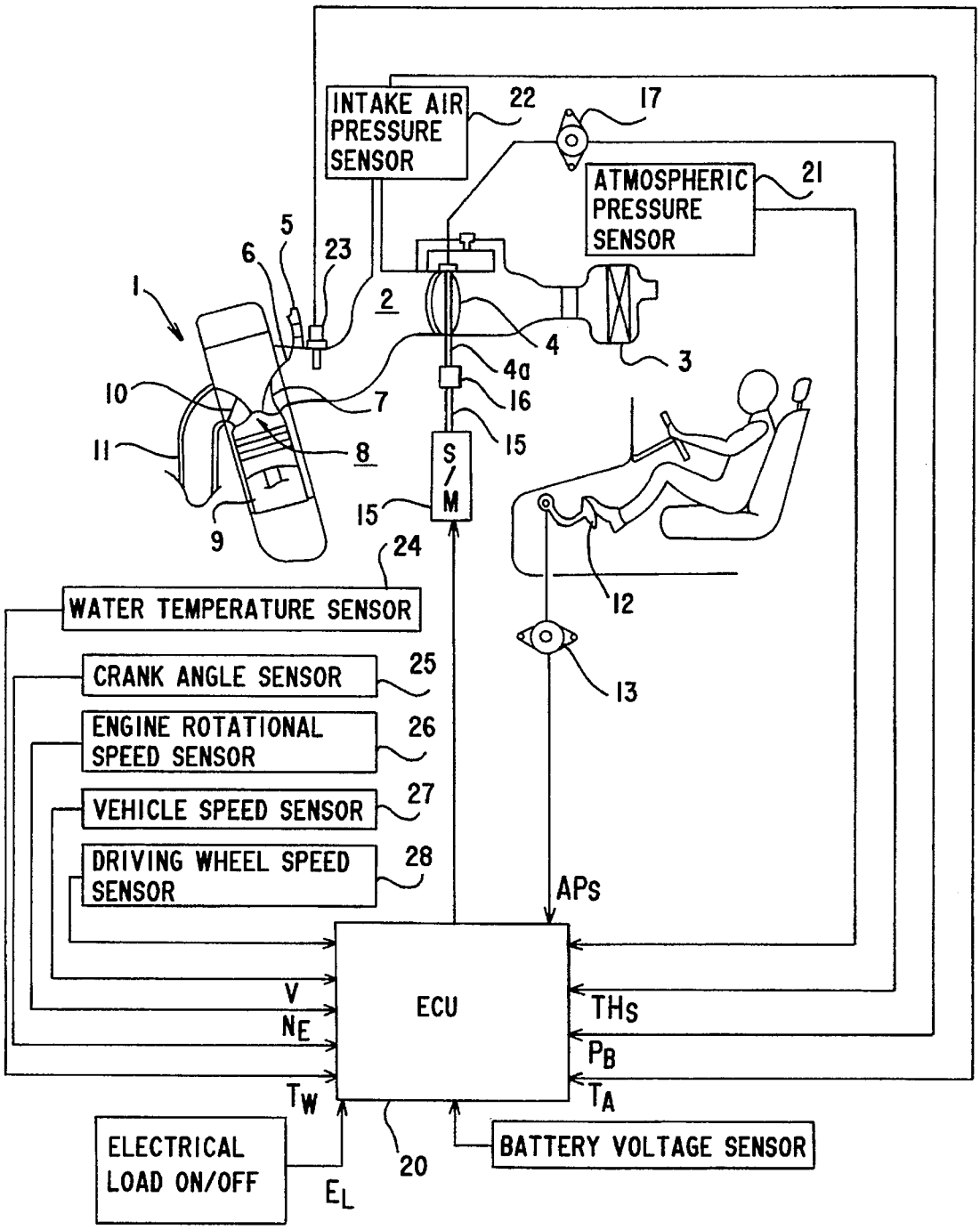
FIG. 2 is an entire schematic view for illustrating a fuel supplying control system of the internal combustion engine of one preferred embodiment of the present invention.

The preferred embodiment is applied to the internal combustion engine mounted on a vehicle and FIG. 2 is an entire schematic view for illustrating the fuel supplying control system for the internal combustion engine.

The intake air passage 2 for supplying fuel to the internal combustion engine 1 is provided with an air cleaner 3 at its upstream side, a throttle valve 4 is arranged in the midway in such a way that the intake air passage 2 can be opened or closed, a fuel injection valve 5 is arranged at the downstream side, air fed into the intake air passage 2 through the air cleaner 3 is adjusted by the throttle valve 4 for its flow rate, enters an intake manifold 6, and further flows into the combustion chamber 8 together with fuel injected by the fuel injection valve 5 through the intake port opened or closed with the air intake valve 7.

The entered mixture gas is ignited to drive a piston 9, passes through an exhaust port opened or closed by the exhaust valve 10 and is discharged out of the engine from the exhaust manifold 11 through the exhaust passage.

In addition, an accelerator pedal 12 is installed at a floor surface of a driver's compartment of a vehicle where the internal combustion engine 1 is mounted, the accelerator pedal 12 is biased by a spring to an idling position and oscillated in response to a pressing action of the driver.

As shown in FIG. 2, the accelerator pedal 12 and the throttle valve 4 are not connected mechanically, a pressing amount of the accelerator pedal 12 is detected by an accelerator sensor 13 comprising a potentiometer arranged at an oscillating shaft of the accelerator pedal 12. The throttle valve 4 is driven to open or close by the stepping motor 15. The stepping motor 15 is operated by a driving signal produced from the electronic control unit ECU 20.

A driving shaft 15*a* of the stepping motor 15 is coaxial with a valve shaft 4*a* of the throttle valve 4 and directly connected to it by a connector part 16 without applying any speed change connector such as a gear and the like.

A normal or reversing rotational angle of the stepping motor 15 becomes an opening or closing angle of the throttle valve 4.

The opening or closing angle of the throttle valve 4 is detected by the throttle sensor 17 comprising a potentiometer or the like and its detected signal is inputted to ECU 20.

An atmospheric pressure sensor 21 is arranged at an upstream side of the air intake passage 2, an intake air pressure sensor 22 for sensing an absolute pressure of intake air is arranged at the downstream side of the throttle valve 4, and further an intake air temperature sensor 23 for use in detecting a temperature of the intake air is arranged at the further downstream side.

In addition, a water temperature sensor 24 for detecting a cooling water temperature corresponding to the second sensor in the present invention is arranged at a proper position near the combustion chamber 8 of the internal combustion engine 1. A crank angle sensor 25 is arranged within a distributor. A sensor 26 for detecting a rotational speed of the engine, a vehicle speed sensor 27 and a driving wheel speed sensor 28 corresponding to the first sensor in the present invention are arranged at proper positions. The detection signals from each of the aforesaid sensors are inputted to the ECU 20.

In addition, in the present control device, detection signals produced from various sensors such as a battery cell sensor 29 for use in detecting a battery voltage are outputted to the ECU 20.

In this case, the stepping motor 15 is a hybrid-type four-phase stepping motor and is driven under a two-phase exciting driving system.

Figure 3:
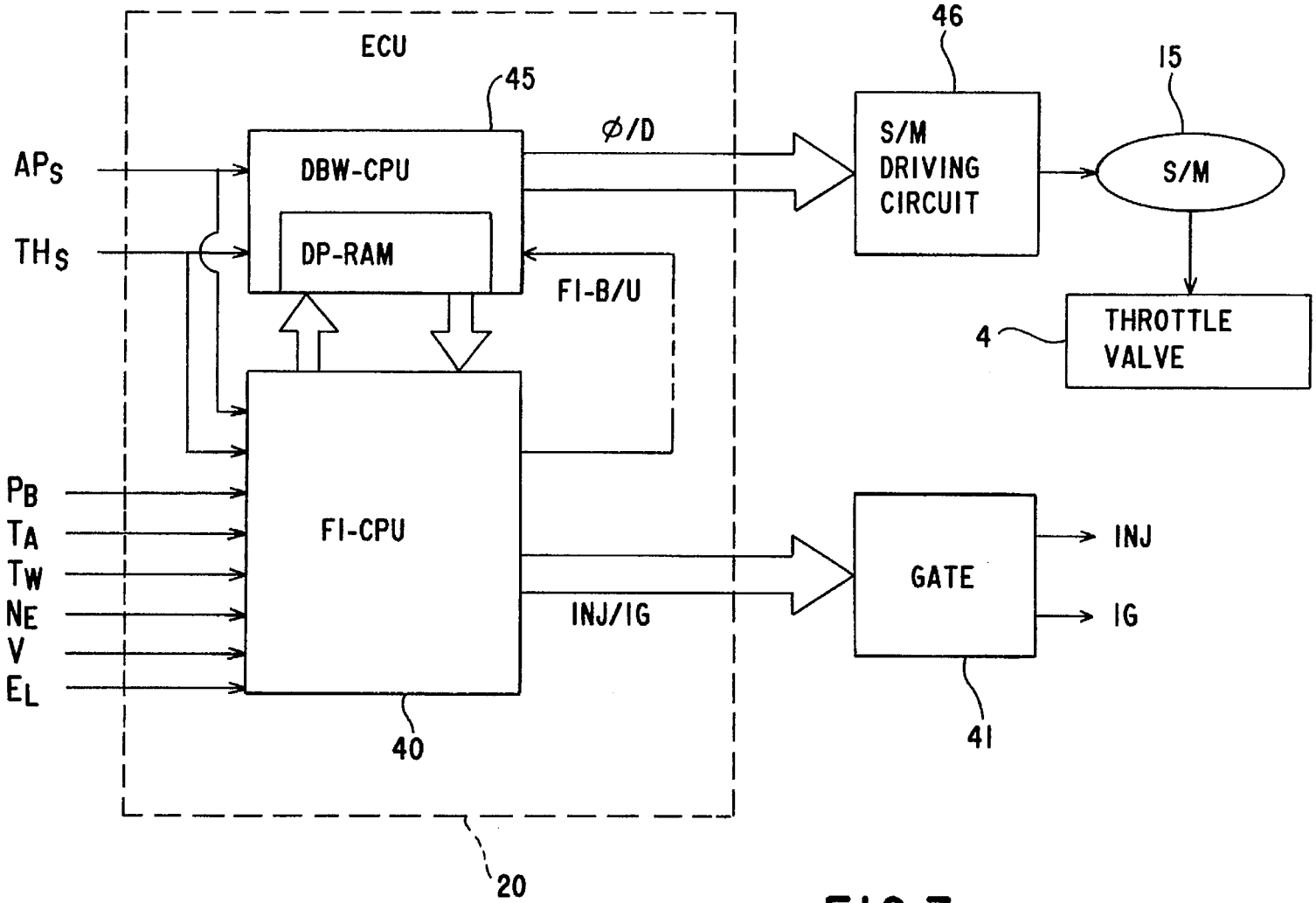
FIG. 3 is a schematic block diagram for showing a control system of the fuel supplying control system.

A schematic block diagram of the present control system is illustrated in FIG. 3.

Within the ECU 20, a fuel supplying control is performed by FI-CPU 40, wherein FI-CPU 40 has inputs of various detection signals from the aforesaid various sensors for detecting an operating state of the internal combustion engine. For example, an absolute pressure $P_B$ in the air intake pipe, an intake air temperature $T_A$, an engine water temperature $T_W$, a rotational speed $N_E$ of the engine, a vehicle speed V, an accelerator pedal angle $AP_S$ produced from the aforesaid accelerator sensor 13, and a throttle valve opening degree $TH_S$ from the throttle sensor 17 or the like are inputted. And an INJ signal for controlling the fuel injection valve 5 and an IG signal for controlling an ignition time are outputted through the gate 41 in response to the operating condition.

An opening degree control for the throttle valve 4 with the stepping motor 15 is carried out by DBW-CPU 45, signals of an accelerator pedal angle $AP_S$ detected by the accelerator sensor 13 and a throttle valve opening degree $TH_S$ detected by the throttle sensor 17 are inputted, a signal with an exciting phase $\phi$ and a duty D for driving the stepping motor 15 is outputted to a stepping motor driving circuit 46, and then the stepping motor 15 is driven by the stepping motor driving circuit 46.

TO FI-CPU 40 are inputted detection signals produced from the accelerator sensor 13 and the throttle sensor 17 as well as signals from other sensors for detecting operating conditions, and a target throttle opening degree based on each of the detection signals is calculated, respectively, and these information are transmitted to DBW-CPU 45 through DP-RAM 42 which gives and takes signals between FI-CPU 40 and DBW-CPU 45.

DBW-CPU 45 determines a final target throttle opening degree $TH_O$ by adding various corrections in midway on the basis of these information, sets the aforesaid exciting phase $\phi$ and a duty D of a current to be supplied to the stepping motor 15 so as to cause the throttle opening degree of the throttle valve 4 to become the final target throttle opening degree $TH_O$ and outputs it.

FI-CPU 40 can back-up the DBW-CPU 45 directly in response to an operating condition or an abnormal state and at this time the exchange of signals through DP-RAM 42 is prohibited.

The final target throttle opening degree $TH_O$ is calculated such that a first target throttle opening degree $TH_{AP}$ calculated mainly with an accelerator pedal angle $AP_S$ detected by the accelerator sensor 13 is added with an idle throttle opening degree $TH_{IDL}$ acting as a second target throttle opening degree as indicated in the following equation (1);

$$TH_O=TH_{AP}+TH_{IDL} \quad (1)$$

In view of the equation (1) above, it is apparent that the idle throttle opening degree $TH_{IDL}$ becomes the final target throttle opening degree $TH_O$ under the idling condition ($TH_{AP}=0$) in which the accelerator pedal 12 is not pressed. The idle throttle opening degree $TH_{IDL}$ is calculated in response to various external loads of the internal combustion engine, and as the accelerator pedal 12 is started to be pressed by a driver, the throttle valve 4 is started to open with the accelerator pedal 12 from the idle throttle opening degree $TH_{IDL}$.

Figure 4:
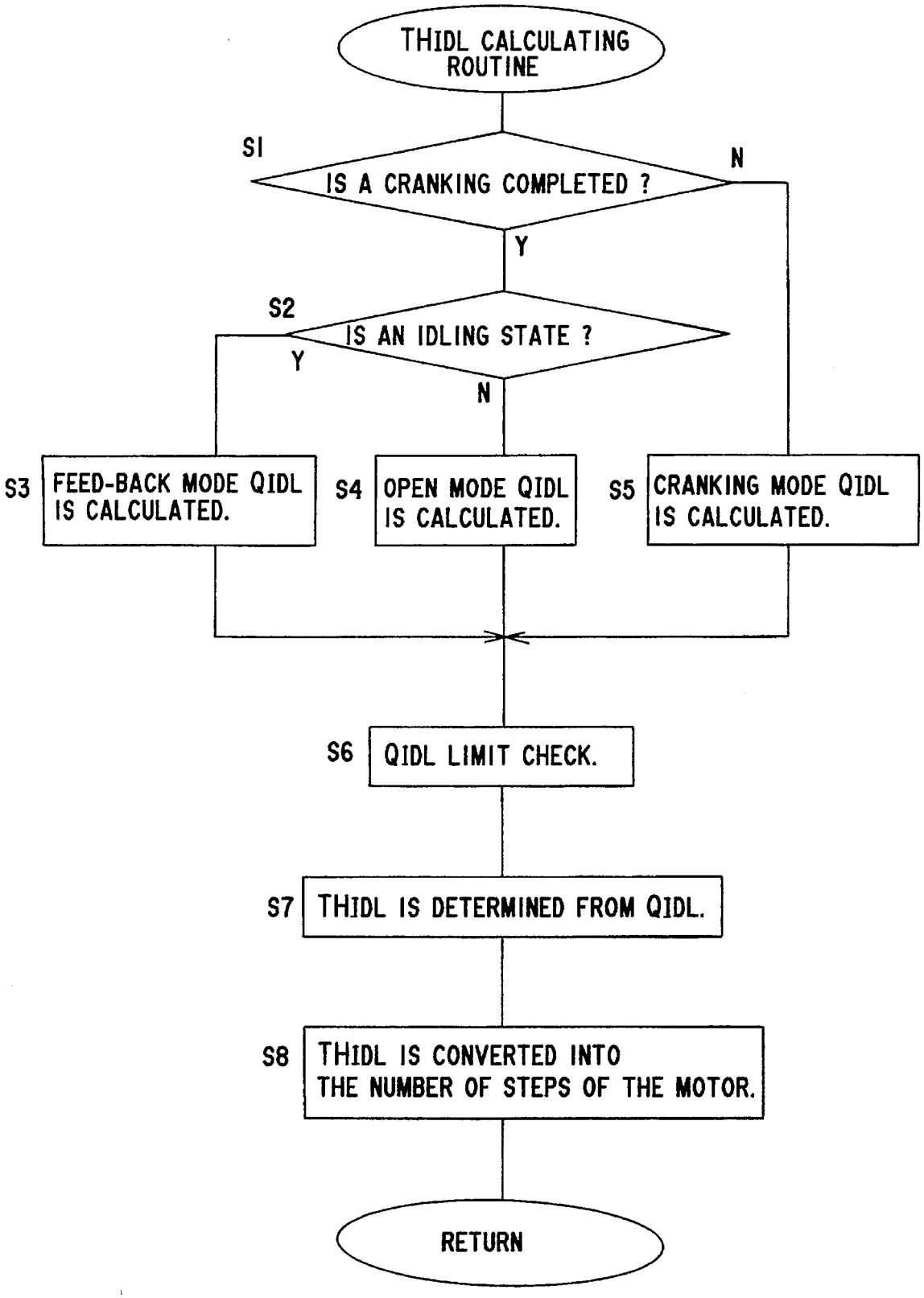
FIG. 4 is a flow chart for showing a procedure for calculating an idle throttle opening degree $TH_{IDL}$ in the control system.

FIG. 4 is a flow chart for indicating a procedure in which this idle throttle opening degree $TH_{IDL}$ is calculated and this procedure will be described in reference to this flow chart.

At first, at the step 1, it is discriminated if a cranking is completed, i.e. whether or not the engine has been started with the starter motor, and if the cranking operation is being carried out, the flow jumps to the step 5 and the target intake air volume $Q_{IDL}$ at the cranking mode is calculated. If the cranking is completed at the step 1, the flow advances to the next step 2, where it is discriminated if the operation is in an idling state, and if the operation is in the idling state, the flow advances to the step 3 and a target intake air volume $Q_{IDL}$ at the feed-back mode is calculated. If the operation is not in the idling state at the step 2, the flow advances to the step 4 and a target intake air volume $Q_{IDL}$ under the open mode is calculated.

The target intake air volume $Q_{IDL}$ at each of the modes is calculated on the basis of the external load in each of the modes, and at the feed-back mode in the step 3, it is calculated by the following equation (2), $$Q_{IDL}=(Q_{FBN}+Q_{LOAD}+Q_{SA})*K_{PAD}+Q_{PA} \quad (2)$$

at the open mode in the step 4, it is calculated by the following equation (3)

$$Q_{IDL}=(Q_{XREF}+Q_{TW}+Q_{LOAD}+Q_{SA})*K_{PAD}+Q_{DEC}+Q_{PA} \quad (3)$$

and at the cranking mode of the step 5, it is calculated by the following equation (4)

$$Q_{IDL}=(Q_{XREF}+Q_{CRST})*K_{PAD}+Q_{PA} \quad (4)$$

In these equations, $Q_{FBN}$ is a feed-back intake air item, $Q_{LOAD}$ is an electrical load item, $Q_{SA}$ is a shot air item, $Q_{XREF}$ is a learning value in a feed-back item, $Q_{TW}$ is a water temperature correction item, $Q_{CRST}$ is a water temperature correcting item when an operation is started, $K_{PAD}$ is an atmospheric pressure correction multiplying item, $Q_{PA}$ is an atmospheric pressure correcting added item, and $Q_{DEC}$ is a deceleration correcting added item.

After the target intake air volume $Q_{IDL}$ is calculated in this way, a limit check for $Q_{IDL}$ is carried out at the step 6 and when the value exceeds a limit value, the limit value is set as the target intake air volume $Q_{IDL}$.

At the next step 7, an idle throttle opening degree $TH_{IDL}$ is retrieved at the table in response to the target intake air volume $Q_{IDL}$.

Figure 5:
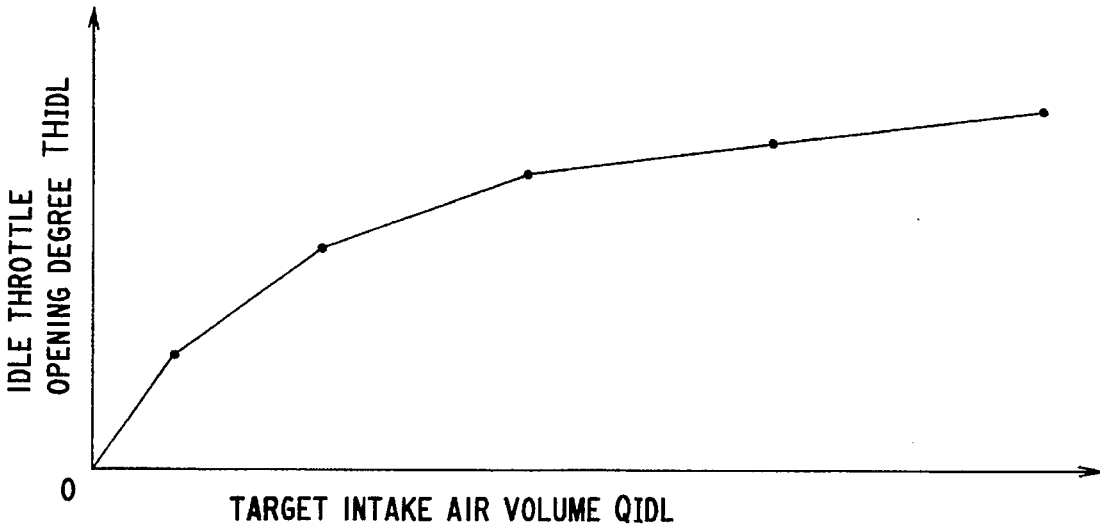
FIG. 5 is a graph for showing a table for retrieving the idle throttle opening degree $TH_{IDL}$ from the target intake air volume $Q_{IDL}$.

A table used for the retrieving operation is indicated by a graph in FIG. 5, wherein the abscissa indicates the target intake air volume $Q_{IDL}$ and the ordinate indicates the idle throttle opening degree $TH_{IDL}$. The snapped line in FIG. 5 indicating the idle throttle opening degree $TH_{IDL}$ retrieved in respect to the target intake air volume $Q_{IDL}$ is directed in a rightward and upward direction, and an increasing rate of the idle throttle opening degree $TH_{IDL}$ is decreased as the target intake air volume $Q_{IDL}$ is increased.

Accordingly, while the target intake air volume $Q_{IDL}$ is small, the idle throttle opening degree $TH_{IDL}$ is also kept small but the variation rate is large, and on the other hand, as the target intake air volume $Q_{IDL}$ is increased, a value of the idle throttle opening degree $TH_{IDL}$ is also increased but the variation rate is low. It corresponds to applying the characteristic curve of $\theta_{TH}$-$G_{AIR}$ shown in FIG. 1 after correcting it into a linear line characteristic.

In addition, at the step 80 the retrieved idle throttle opening degree $TH_{IDL}$ is converted into the number of steps in the motor.

The idle throttle opening degree $TH_{IDL}$ calculated as described above is added to the first target throttle opening degree $TH_{AP}$ calculated mainly in reference to the accelerator pedal angle $AP_S$ as indicated by the equation (1) above for obtaining the final target throttle opening degree $TH_O$, and then the throttle valve 4 is driven so as to get the final target throttle opening degree $TH_O$.

Figure 1:
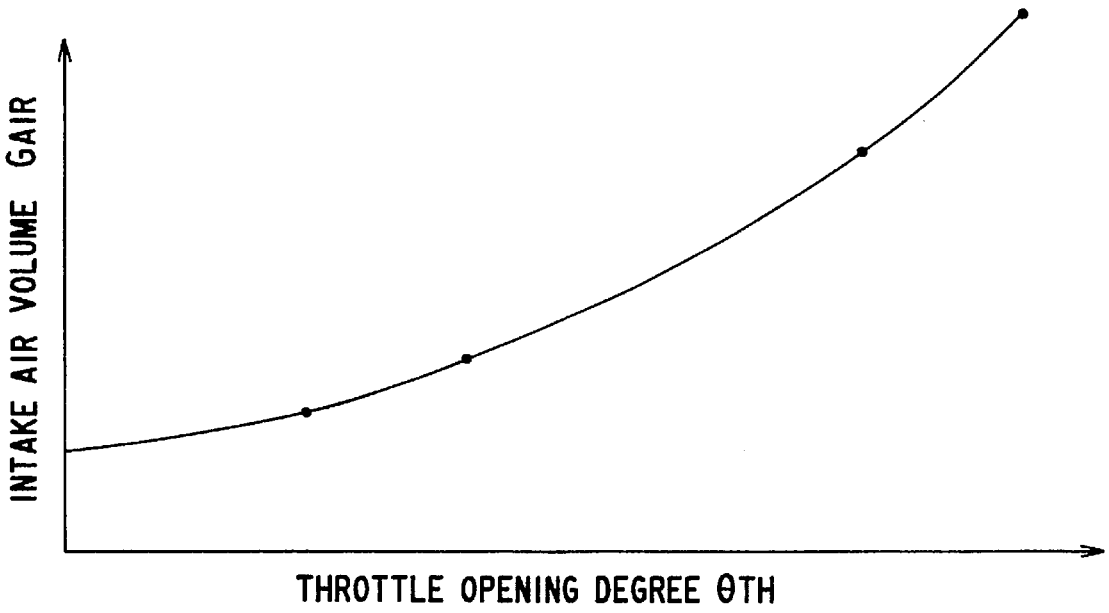
FIG. 1 is a view for illustrating a relation of the intake air volume $G_{AIR}$ in respect to the throttle opening degree $\theta_{TH}$.

Since the idle throttle opening degree $TH_{IDL}$ added to the first target throttle opening degree $TH_{AP}$ for attaining the final target throttle opening degree $TH_O$ is calculated through a retrieval at a table shown in FIG. 5 in response to the target intake air volume $Q_{IDL}$, the $\theta_{TH}$-$G_{AIR}$ characteristic of FIG. 1 is corrected and applied, and so it is possible to adjust always the intake air volume pertinently, irrespective of variation in characteristic caused by deterioration in durability under clogging of carbon around the throttle valve or in a bypass air passage, or variation in water temperature or intake absolute pressure.

In particular, it is possible to prevent rotational speed of the engine from being excessively varied even if an external load is varied due to ON/OFF of an electrical load $E_L$ at an operational region near the target rotational speed of the engine when the idle feed-back control is carried out.

What is claimed is:

1. An intake air volume control device for an internal combustion engine in which there is provided a throttle opening degree control means for driving a throttle valve arranged in an air intake system of the internal combustion engine and adjusting an intake air volume, comprising:

sensor means for detecting operational states of the internal combustion engine;

a target intake air volume calculating means for calculating a target intake air volume in response to operational states of the internal combustion engine; and a target throttle opening degree setting means for setting a target throttle opening degree in response to said target intake air volume calculated by said target intake air volume calculating means, wherein said target throttle opening degree setting means calculates a throttle opening degree in response to an accelerator pedal angle and calculates an idle throttle opening degree in response to outputs from said sensor means of the internal combustion engine, said throttle valve being driven and controlled by said throttle opening degree control means in response to said target throttle opening degree.

2. An intake air volume control device for an internal combustion engine as set forth in claim 1, wherein said target throttle opening degree setting means comprises a first target throttle opening degree calculating means for calculating said throttle opening degree in response to said accelerator pedal angle, and a second target throttle opening degree calculating means, operably coupled to said sensor means, for calculating said idle throttle opening degree in response to said outputs from said sensor means, and said external loads of said internal combustion engine, wherein said target throttle opening degree setting means controls an idling rotational speed of the internal combustion engine to a target rotational speed by a feed-back control, and sets a final target throttle opening degree by adding outputs from said first and second target throttle opening degree calculating means.

3. An intake air volume control device for an internal combustion engine as set forth in claim 2, wherein said second target throttle opening degree calculating means calculates said idle throttle opening degree in response to an electrical load having influence on said operational states of the internal combustion engine.

* * * * *